United States Patent [19]

Mizuno et al.

[11] Patent Number: 4,669,962

[45] Date of Patent: Jun. 2, 1987

[54] SCROLL COMPRESSOR WITH PRESSURE DIFFERENTIAL MAINTAINED FOR SUPPLYING OIL

[75] Inventors: Takao Mizuno; Tetsuya Arata; Naoshi Uchikawa; Akira Murayama; Takahiro Tamura; Hiroaki Kuno, all of Shimizu, Japan

[73] Assignee: Hitachi, Ltd., Tokyo, Japan

[21] Appl. No.: 767,812

[22] Filed: Aug. 21, 1985

[30] Foreign Application Priority Data

Aug. 22, 1984 [JP] Japan ..... 59-173215

[51] Int. Cl.[4] ..... F04C 18/04; F04C 29/02; F04C 29/10

[52] U.S. Cl. ..... 418/55; 418/57; 418/94

[58] Field of Search ..... 418/55, 57, 94

[56] References Cited

U.S. PATENT DOCUMENTS 4,365,941 12/1982 Tojo et al. ..... 417/372
4,596,520 6/1986 Arata et al. ..... 418/94

FOREIGN PATENT DOCUMENTS 58-160580 9/1983 Japan ..... 418/57
58-160583 9/1983 Japan ..... 418/57
58-183887 10/1983 Japan ..... 418/57

*Primary Examiner*—John J. Vrablik
*Attorney, Agent, or Firm*—Antonelli, Terry & Wands

[57] ABSTRACT

A scroll compressor including a stationary scroll and an orbiting scroll, with an intermediate pressure chamber being defined on a back side of the orbiting scroll member and being in communication with a pressure chamber through a communication hole to produce a force for pressing the orbiting scroll against the stationary scroll. Oil in an oil sink is supplied to sliding portions by a differential pressure between a pressure in the air tight container and a pressure in the intermediate pressure chamber. A valve is provided for switching the connection of the intermediate pressure chamber to a higher intermediate pressure side or to a lower intermediate pressure side of the compressor. The valve is constructed such that the intermediate pressure chamber is connected to the lower intermediate pressure side of the compressor when a discharge pressure of the compressor is lower than a certain value and connected to the higher intermediate pressure side of the compressor when the discharge pressure is higher than a certain value so that a proper oil supply pressure is maintained over a wide operational range.

5 Claims, 7 Drawing Figures

SCROLL COMPRESSOR WITH PRESSURE DIFFERENTIAL MAINTAINED FOR SUPPLYING OIL

BACKGROUND OF THE INVENTION

This invention relates to a scroll compressor of a differential pressure oil-supply type, and, more particularly to a scroll compressor including means for maintaining a differential pressure oil-supply in a wide operation range.

A scroll compressor of the aforementioned type is proposed in, for example, U.S. Pat. No. 4,365,941 wherein an intermediate pressure chamber on the back of an orbiting scroll.

A pressure of the intermediate pressure chamber is governed by a pressure of an airtight chamber which is communicated with the intermediate pressure chamber through a communication hole and roughly maintained at an average pressure of the airtight chamber. The pressure of the airtight chamber is governed by a suction pressure according to characteristics of the scroll compressor and that value is determined by a position of the communication hole. In other words, the intermediate pressure is detemined by the suction pressure and the communication hole position independent of discharge pressure.

However, in the above-noted scroll compressor, as oil is supplied to the sliding part by a differential pressure between the discharge pressure and the intermediate pressure, if the differential pressure is small or null, the oil cannot be supplied to the sliding part so that the operation is impossible. Also, when the communication hole is provided at the position where the intermediate pressure is low in order to maintain the differential pressure, a force pressing the orbiting scroll against a stationary scroll produced by the intermediate pressure is insufficient when the pressure differential between the suction pressure and the discharge pressure is so great that sealing between tips of lapping parts and flat plate parts becomes impossible.

It is an object of the pressent invention to provide a scroll compressor which facilitates maintaining an oil-supply pressure within a wide operation range.

In a scroll compressor, when suction pressure is constant and discharge pressure is low, the force pressing the orbiting scroll against the stationary scroll can be small compared to when the discharge pressure is high. According to the present invention, a scroll compressor is provided with a valve which can switch connection of an intermediate pressure chamber to a lower intermediate pressure or to a higher intermediate pressure of a compressor part, and is constructed so that when the discharge pressure is below a certain value, the intermediate pressure chamber is connected to the lower intermediate pressure side of the compressor by the valve to maintain oil-supply pressure and, when the discharge pressure is above the certain value, the intermediate pressure chamber is connected to the higher intermediate pressure side of the compressor part by the valve which maintains the oil-supply pressure.

DETAILED DESCRIPTION

Figure 1:
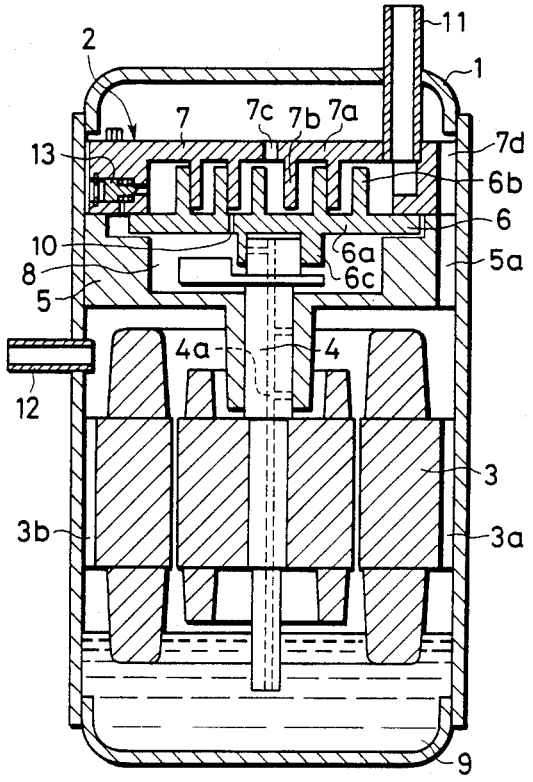
FIG. 1 is a sectional view of an embodiment of a scroll compressor of the present invention.

Referring now to the drawings wherein like reference numerals are used throughout the various views to designate like parts and, more particularly, to FIG. 1 according to this figure, a scroll compressor includes a compressor part generally designated by the reference numeral 2 disposed at an upper part in an airtight container 1 and a motor part 3 disposed at a lower part in the airtight container 1, with the compressor part 2 including an orbiting scroll 6 and a stationary scroll 7 which mesh with each other. The orbiting scroll 6 includes a flat end plate **6*a* and a spiral lapping part 6*b* vertical to the flat end plate 6*a*. The stationary scroll 7 includes a flat end plate 7*a* and a spiral lapping part 7*b* vertical to the flat end plate 7*a* and fixed to a frame 5. A lower end of a crank shaft 4, joined with a rotating shaft of a motor 3, is immersed in an oil sink 9 defined at the bottom of the airtight container 1. An oil path 4*a* whose lower end is opened in a shaft axis and whose upper end is opened at an eccentric position with respect to the rotating shaft axis is provided in the crank shaft 4. A communication hole 10 is provided in the orbiting scroll 6 at a position where an intermediate or back pressure between a suction pressure and a discharge pressure is obtained and an intermediate pressure chamber 8 in which the pressure is at the intermediate value is also provided. An upper end of the crank-shaft 4 is coupled with a boss part 6*c* extending downwardly from the orbiting scroll 6**.

Figure 2:
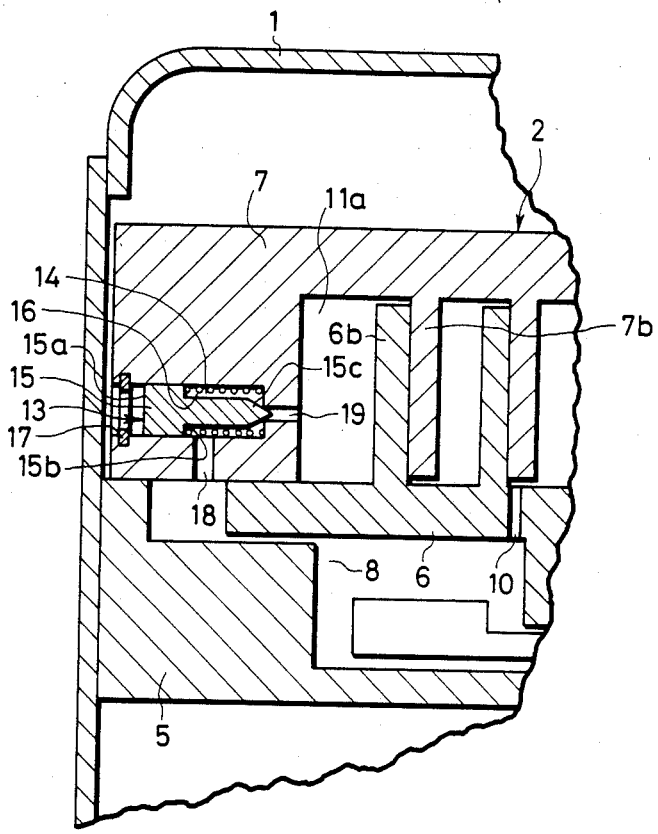
FIG. 2 is an enlarged sectional view of a main part of FIG. 1.

As shown in FIG. 2, a valve 13 connects or disconnects a communication between a suction chamber **11*a* of the compressor part 2 and the intermediate pressure chamber 8, with the valve including a cylinder 14 formed in the stationary scroll 7, a valve body 15 incorporated in the cylinder 14, a compession spring 16 for pressure setting and a stopper ring 17 for preventing the valve body from coming out. One side of the cyliner 14 communicates with the airtight container 1 and the other side of the cylinder 14 communicates with the intermediate pressure chamber 8 through a communication hole 18 and also communicates with the suction chamber 11*a* through a communication hole 19. The valve body 15 includes a surface 15*a* for receiving the internal pressure of the airtight container 1 at one end and a surface 15*b* for receiving the internal pressure of the intermediate pressure chamber 8 on the back side of the pressure receiving surface 15*a*. The valve body 15 also has a needle part 15*c* which can open and close the communication hole 19 at its other end. The compression spring 16 is placed between the pressure receiving surface 15*b* of the valve body 15 and a side wall of the cylinder 14. The stopper ring 17 is fitted into an annular groove provided along an inside wall of the cylinder 14 and prevents the valve body 15** from coming out.

When the pressure differential between the pressures applied to both pressure receiving surfaces of the valve body 15 of the valve 13 is higher than the spring force of the compression spring 16, the valve body 15 is shifted to the position where the needle part 15*c* closes the communication hole 19, in other words, it disconnects the connection between the intermediate pressure chamber 8 and the suction chamber 11*a*. When the pressure differential is lower than the spring force of the compression spring 16, the valve body 15 is shifted by the spring force to the position where its needle part opens the communication hole 19, in other words, it communicates the intermediate pressure chamber 8 to the suction chamber 11*a*.

Referring to FIG. 1, the orbiting scroll 6 orbits as the boss part 6*c* is rotated in the intermediate pressure chamber 8 of the frame 5 by the rotation of the crankshaft 4. By the movement of the contact points between the orbiting lapping part 6*b* and the stationary lapping part 7*b*, the gas drawn through a suction tube 11 is compressed while flowing through the spiral chamber from the outside to the inside, is discharged into an airtight container 1 through a discharge outlet 7*c* provided at the center of the stationary scroll 7 and flows through a path 7*d* provided on an outer periphery of the stationary scroll 7 and a path 5*a* of an outside periphery of the frame 5. A part of the gas having passed through the paths 4*d* and 5*a* flows through outside periphery paths 3*a* and 3*b* of the motor 3 and the other part of the gas flows between the frame 5 and the motor 3, and all gas is discharged out of the machine through the discharge tube 12. The volume of the airtight chamber, defined by the lapping parts 6*b* and 7*b* and the flat end plates 6*a* and 7*a* of the orbiting scroll 6 and stationary scroll 7, is reduced according to the movement from the outside to the center so that the pressure of the gas contained therein is increased according to the movement. The pressure in the intermediate pressure chamber 8, defined by the orbiting scroll 6 and the frame 5, is, as mentioned above, maintained at the intermediate pressure between the suction pressure and the discharge pressure by the communication hole 10. With the pressure differential between the intermediate pressure and the internal pressure of the compression part, the orbiting scroll 6 is pressed against the stationary scroll 7 to maintain the tight contact of the sealing part of a gap between the tips of the lapping parts 6*b* and 7*b* and the flat plate parts 7*a* and 6*a*. Moreover, as the pressure in the airtight container 1 is the discharge pressure and higher than that in the intermediate pressure chamber 8, freezer oil in the oil sink is pushed up through the oil path 4*a* in the crank shaft by the differential pressure between those two pressures and supplied to a sliding part.

Figure 3:
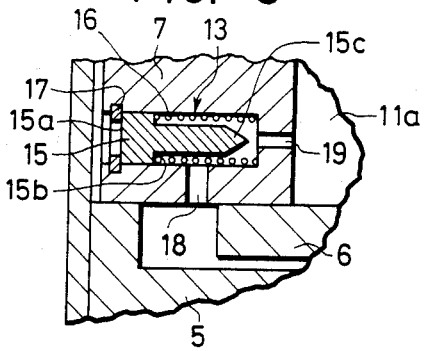
FIG. 3 is a sectional view for explaining an operation of the valve shown in FIGS. 1 and 2.

Referring to FIGS. 2 and 3, an operation of the valve 13 is hereinunder described. Ps denotes the suction pressure; Pb, the intermediate pressure; Pd, the discharge pressure; K, the spring force of the compression spring; SA, the cross sectional area of the cylinder 14; and SB, the cross sectional area of the communication hole 19. Because the relation Ps=Pb=Pd is maintained before start, the valve body 15 of the valve 13 is pressed against the stopper ring 17 by the spring force K as shown in FIG. 3. In other words, the valve body 15 is shifted to the position where it fluidly connects the intermediate pressure chamber 8 to the suction chamber 11*a*. When the compressor is started at this state, if the discharge pressure Pd is increased to the value which conforms to following formula (1):

$$Pd \times SA > Pb \times SA + K \quad (1)$$

the valve body 15 is shifted to the position shown in FIG. 2 and the communication hole 19 is closed by its needle part 15*c*. In this state, the inside of the airtight container 1, the suction chamber 11*a* and the back pressure chamber 8 are separated from each other and the compressor is driven essentially under the same condition as if the valve did not exist.

When the discharge pressure Pd cannot reach a value high enough to conform to the formula (1), in other words the differential pressure between pressures applied to both pressure receiving surfaces of the valve body 15 is lower than the spring force K, the valve body 15 is maintained at the position shown in FIG. 3 and the intermediate pressure chamber 8 is communicated with the suction chamber 11*a* through communication holes 18 and 19 so that the intermediate pressure Pb is low. The fact that the intermediate pressure Pb is maintained at a value lower than the normal intermediate pressure means that the differential pressure between the discharge pressure and the intermediate pressure is large and the oil-supply pressure (the differential pressure between the discharge pressure and the intermediate pressure) is maintained; therefore, a wide range of operation can be obtained. When the intermediate pressure is maintained relatively low, a pressing force of the orbiting scroll 6 is small. However, as the discharge pressure is also low, the pressing force may be small and this is also a convenient point.

Then the case when the discharge pressure is reduced during operation, for instance by reduction of the load, is hereinunder described. While the needle part 15*c* of the valve body 15 closes the communication hole 19, if the discharge pressure is decreased to the value which conforms to the following formula (2):

$$Pd \times SA < Pb \times (SA - SB) + Ps \times SB + K \quad (2)$$

the valve body 15 is shifted to the direction of opening the communication hole 19 and the intermediate pressure is maintained at a pressure lower than a normal pressure.

Figure 4:
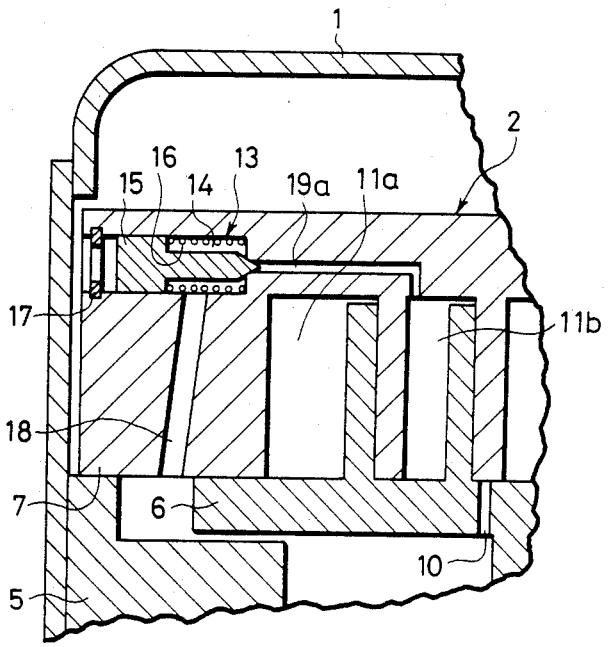
FIG. 4 is a sectional view of another embodiment of a scroll compressor of the present invention.

FIG. 4 shows another embodiment of the present invention and this embodiment is different from the one shown in FIG. 2 at the point that the position where a communication hole 19*a* is opened is provided in an airthight chamber 11*b* of a compressor part 2 in which a pressure is lower than the intermediate pressure.

Also in this embodiment, operation principle is basically the same as the one shown in FIG. 2 and, if Ps is substituted by Ps′ (a pressure in the airtight chamber ll*b*) in the formulae (1) and (2), the same performance and effect as described by FIG. 2 can be realized.

Still another embodiment of a scroll compressor of the present invention is hereinunder described with reference to FIG. 5 through FIG. 7. This embodiment is the same as FIG. 1 except for a valve 113 and a part of a compressor part 200.

Figure 5:
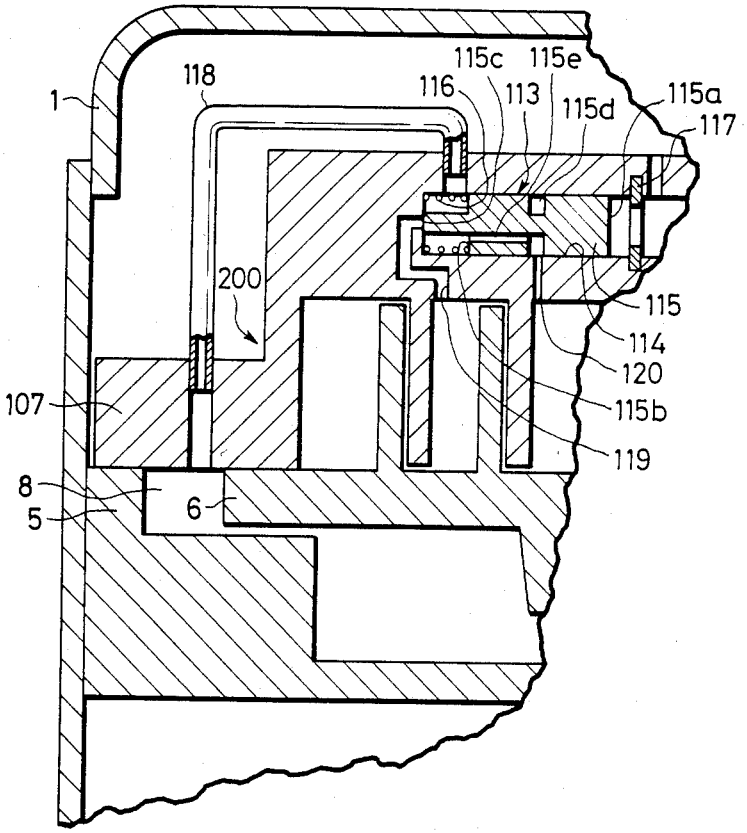
FIG. 5 is a sectional view of the main part of a scroll compressor according to further another embodiment the present invention.
Figure 6:
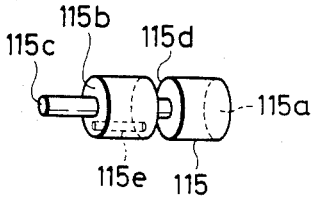
FIG. 6 is a perspective view of a valve body of a valve shown in FIG. 5.

In FIG. 5, the scroll compressor is provided with a valve generally designated by the reference numeral 113 at the stationary scroll 107. The valve 113 is constituted by a cylinder 114 formed in the stationary scroll 107, a valve body 115 incorporated in the cylinder 114, a spring 116 and a stopper ring 117. A pipe 118 communicating with the intermediate pressure chamber 8, a first port 119 communicating with a lower intermediate pressure side of the compressor part 200 and a second port 120 communicating with a higher intermediate pressure side of the compressor part 200 are connected to the cylinder 114. One end surface 115*a* of the valve body 115 is formed so as to receive a fluid pressure which is normally the discharge pressure and a seat part 115*c* which opens and closes the first port 119 protrudes from the other end surface 115*b* of the valve body 115. An annular groove 115*d* is provided at a central part of the valve body 115 and a valve hole 115*e* which is opened at the annular groove 115*d* and the end surface 115*b* is provided. The spring 116 is placed between a side wall of the cylinder 114 and the end surface 115*b* of the valve body 115 and actuates the valve body 115 toward the direction of opening the first port 119. The stopper ring 117 is attached to an inner wall of the cylinder 114 and prevents the valve body 115 from projecting out.

Figure 7:
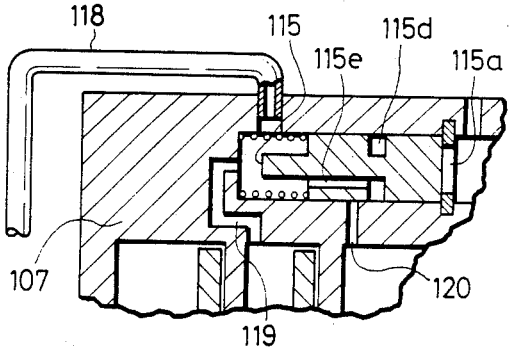
FIG. 7 is a sectional view of FIG. 5 for explaining the operation of the valve.

With the valve 113 of the above constitution, when the valve body 115 is shifted to the position where the first port 119 is closed by the seat part 115*c*, the pipe 118 is fluidly connected to the second port 120 through the annular groove 115*d* and the valve hole 115*e* and, when the valve body 115 is shifted to the position where the valve body 115 touches the stopper ring 117 as shown in FIG. 7, the pipe 118 is connected to the first port 119.

Then the operation of the embodiment of FIG. 5 is as follows:

Because the pressures in the compressor are normally balanced when the compressor starts, the valve body 115 of the valve 113 is shifted to the position where it touches the stopper ring 117 by the spring 116 as shown in FIG. 7. At this state, the pipe 118 is connected to the first port 119. In other words, the intermediate pressure chamber 8 is connected to the lower intermediate pressure side of the compressor part 200 when the compressor starts.

After the compressor starts, when the discharge pressure exceeds a certain value, the discharge pressure applied to one end surface 115*a* of the valve body 115 overcomes the spring force of the spring 116 and the valve body 115 is shifted to the position shown in FIG. 5. Then the first port 119 is closed by the seat part 115*c* and at the same time the pipe 118 is connected to the second port 120 through the annular groove 115*d* and the valve hole 115*e*. In other words, when the discharge pressure exceeds a certain value, the intermediate pressure chamber 8 is connected to the higher intermediate pessure side of the compressor part 200.

As described above, when the discharge pressure is below a certain value, the intermediate pressure is maintained at a relatively low value and, when the discharge pressure exceeds a certain value, the intermediate pressure is maintained at a relativey high value. The fact that the intermediate pressure is maintained at a relatively low value when the discharge pressure is low means that the oil-supply pressure, the pressure differential between the discharge and the intermediate pressure, can be maintained, and the range of operation can be widened in terms of the oil-supply. When the intermediate pressure is maintained at a relatively low value, the pushing-up force for the orbiting scroll 6 is small. However, the discharge pressure is also low in this case and the pushing-up force may be small and this is also a convenient point.

As described above, the intermediate pressure is controlled in accordance with the fluctuation of the discharge pressure by a valve of simpler structure to facilitate maintaining sufficient differential pressure between two pressures required for oil-supply and hence a wider range of operation is possible.

What we claim is:

1. A scroll compressor comprising a compressor means including an orbiting scroll and a stationary scroll coupled together and frame means for supporting the orbiting scroll, an air tight container means for accommodating the compressor means, a discharge outlet means for discharging a gas from said compressor means, said discharge outlet means being in communication with an interior of the air tight container means to maintain a high internal pressure in said air tight container means, and a pressure of the gas during compression in said compressor means is introduced into an intermediate pressure chamber defined on a backside of the orbiting scroll for producing a force for pressing the orbiting scroll against the stationary scroll, and means for supplying oil to a sliding component of the scroll compressor by utilizing a pressure differential between the high pressure in the air tight container and the pressure in the intermediate pressure chamber, a valve means is provided for switching a connection of said intermediate pressure chamber to a higher intermediate pressure said or to a lower intermediate pressure said of said compressor means, said valve means including means for enabling the intermediate pressure chamber to be connected to the lower intermediate pressure side of the compressor means when a discharge pressure of the compressor means is lower than a certain value and to be connected to the higher intermediate pressure side of the compressor means when the discharge pressure is higher than a certain value.

2. A scroll compressor as claimed in claim 1, wherein said valve means includes a cylinder formed in said stationary scroll, said cylinder having a first cylindrical side portion opening into a higher intermediate pressure side chamber of said compressor means and a second cylindrical side portion opening into said intermediate pressure chamber and a wall portion opening into a lower intermediate pressure side chamber of said compressor means, a valve body means disposed in said cylinder and having a receiving surface for the discharge pressure of said compressor means on one side thereof and a receiving surface for the pressure of said lower intermediate pressure side chamber of said compressor means on an opposite side thereof, and a pressure setting spring means provided between said lower intermediate pressure side chamber side receiving surface of said valve body means and a wall of said cylinder whereby, when a differential pressure between pressures applied to said two pressure receiving surfaces is larger than a force of said pressure setting spring means, said valve body means is shifted to a position where said valve body means interrupts the connection between said intermediate pressure chamber and said lower intermediate pressure side chamber and connected said intermediate pressure chamber to said higher intermediate pressure side chamber through said first cylindrical side portion and, when said differential pressure is smaller than the force of said pressure setting spring means said valve body means is shifted to a position where the valve body means connects said intermediate pressure chamber with said lower intermediate pressure side chamber and interrupts communication between said intermediate pressure chamber and said higher intermediate pressure side chamber.

3. A scroll compressor comprising:

an air tight container means provided with a discharge port, a suction port, and an oil containing portion;

a compressor means including an orbiting scroll and a stationary scroll coupled together, and provided with a discharge outlet communicating with an interior of said air tight container means;

a frame means fixedly mounted on said air tight container means and supporting said compressor means;

an intermediate pressure chamber defined by said frame means and a backside of said orbiting scroll;

a first passage means for communicating said intermediate pressure chamber and a first portion of said compressor means in which an intermediate pressure between a discharge pressure and a suction pressure is obtained, the intermediate pressure being introduced into said intermediate pressure chamber producing a force for pressing said orbiting scroll toward said stationary scroll;

motor means incorporated in said air tight container means;

a shaft means, engaged with said motor means and said orbiting scroll for transmitting a driving force from said motor means to said orbiting scroll, said shaft means including an oil path through which oil in said oil containing portion is supplied to a sliding part between said orbiting scroll and said shaft means by a differential pressure between the discharge pressure applied on the oil in said oil containing portion and the intermediate pressure in said intermediate pressure chamber;

a second passage means for communicating said intermediate pressure chamber means with a second portion of said compressor means in which the pressure is lower than the intermediate pressure in said first portion of said compressor means; and a valve means, mounted on said second passage means and communicated with said discharge outlet for controlling the communication between said intermediate pressure chamber and said second portion of said compressor means in accordance with the discharge pressure so that the intermediate pressure chamber is fluidly connected to said second portion of said compressor means when the discharge pressure of said compressor means is lower than a certain value and disconnected from said second portion of said compressor means when the discharge pressure is higher than a certain value, and wherein said valve means is mounted on said first passage means in addition to said second passage means, said valve means further including means for fluidly disconnecting said intermediate pressure chamber from said first portion of said compressor means when the discharge pressure is lower than a certain value and connecting said first portion of said compressor means when the discharge pressure is higher than a certain value, whereby the valve means switches the connection of said intermediate pressure chamber to one of said first and second portions of said compressor means to that the intermediate pressure chamber is connected to said second portion of said compressor means when the discharge pressure is lower than a certain value when connected to said first portion of said compressor means when the discharge pressure is higher than a certain value.

4. A scroll compressor comprising:

an airtight container means provided with a discharge port and a suction port and an oil sink at a lower portion thereof;

a motor means disposed in said air tight container means disposed in said air tight container means at a position above said oil sink and secured to said air tight container means;

an orbiting scroll having an end plate and a spiral wrap;

a stationary scroll member having an end plate and spiral wrap with the stationary and orbiting scroll members being arranged such that the spiral wraps mesh with each other so as to form a compressor means, said compressor means having a suction chamber fluidly connected to said suction port and a discharge outlet opening into an interior of said air tight container and fluidly connected to said discharge port of said air tight container means through the interior of said air tight container means;

an intermediate chamber defined by said frame means and said orbiting scroll;

a first passage means for communicating said intermediate pressure chamber with a first position of said compressor means from which an intermediate pressure between a suction pressure and a discharge pressure is obtained;

shaft means passing through said frame means and connected to said orbiting scroll and to said motor means for driving said orbiting scroll, said shaft means having oil means through which oil in said oil sink is supplied into sliding portions between said shaft means and portions of said orbiting scroll and said frame means contacting said shaft means by a differential pressure between a discharge pressure applied on oil in said oil sink and an intermediate pressure in said intermediate pressure chamber;

a second passage means for communicating said intermediate pressure chamber with a second portion of said compressor means in which a lower pressure than said intermediate pressure is obtained;

a valve means communicating with said discharge outlet and provided on said first passage means and said second passage means so as to switch fluid connection of said intermediate pressure chamber from one of said first and second portions of said compressor means to the other in accordance with the discharge pressure so that the fluid connection of said intermediate pressure chamber is switched from said first portion of said compressor means to said second portion of said compressor means when the discharge pressure is lower than a certain value and switched to said first portion of said compressor means when the discharge pressure is higher than the certain value.

5. A scroll compressor as defined in claim 4, wherein said valve means is formed in said stationary scroll, and said valve means and said intermediate pressure chamber are fluidly connected by a pipe means serving as a common passage to said first and second passage means.

* * * * *